US009115596B2

(12) United States Patent
Clouse

(10) Patent No.: US 9,115,596 B2
(45) Date of Patent: Aug. 25, 2015

(54) BLADE OUTER AIR SEAL HAVING ANTI-ROTATION FEATURE

(75) Inventor: Brian Ellis Clouse, Saugus, MA (US)

(73) Assignee: United Technologies Corporation, Hartford, CT (US)

( * ) Notice: Subject to any disclaimer, the term of this patent is extended or adjusted under 35 U.S.C. 154(b) by 788 days.

(21) Appl. No.: 13/568,240

(22) Filed: Aug. 7, 2012

(65) Prior Publication Data

US 2014/0044528 A1 Feb. 13, 2014

(51) Int. Cl.

| | |
|---|---|
| ***F01D 25/00*** | (2006.01) |
| ***F01D 11/12*** | (2006.01) |
| *F01D 11/24* | (2006.01) |

(52) U.S. Cl.

CPC ..... *F01D 25/00* (2013.01); *F01D 11/125* (2013.01); *F01D 11/127* (2013.01); *F01D 11/24* (2013.01); *Y10T 29/49297* (2015.01)

(58) Field of Classification Search

CPC ..... F01D 11/127; F01D 11/08

See application file for complete search history.

(56) References Cited

U.S. PATENT DOCUMENTS

| | | | | |
|---|---|---|---|---|
| 5,791,871 | A | 8/1998 | Sech et al. | |
| 6,652,226 | B2 * | 11/2003 | Albrecht et al. | 415/173.4 |
| 7,144,220 | B2 | 12/2006 | Marcin, Jr. | |
| 7,553,128 | B2 | 6/2009 | Abdel-Messeh et al. | |
| 7,721,433 | B2 | 5/2010 | Thompson et al. | |
| 7,988,410 | B1 | 8/2011 | Liang | |
| 8,061,979 | B1 | 11/2011 | Liang | |
| 8,118,547 | B1 | 2/2012 | Liang | |
| 2006/0216146 | A1 | 9/2006 | Thompson et al. | |
| 2008/0211192 | A1 | 9/2008 | Pietraszkiewicz et al. | |
| 2009/0214329 | A1 | 8/2009 | Joe et al. | |
| 2011/0044803 | A1 | 2/2011 | Di Paola et al. | |
| 2011/0044804 | A1 * | 2/2011 | DiPaola et al. | 415/173.1 |
| 2011/0171011 | A1 * | 7/2011 | Lutjen et al. | 415/173.5 |

* cited by examiner

*Primary Examiner* — Dwayne J White
*Assistant Examiner* — Cameron Corday
(74) *Attorney, Agent, or Firm* — Kinney & Lange, P.A.

(57) ABSTRACT

A blade outer air seal (BOAS) for a gas turbine engine according to an exemplary aspect of the present disclosure includes, among other things, a seal body having a radially inner face and a radially outer face that axially extend between a leading edge portion and a trailing edge portion. At least one of the leading edge portion and the trailing edge portion includes a solid wall and a perforated wall. At least a portion of the perforated wall is spaced from the solid wall such that a passage extends between the solid wall and the perforated wall.

18 Claims, 5 Drawing Sheets

BLADE OUTER AIR SEAL HAVING ANTI-ROTATION FEATURE

BACKGROUND

This disclosure relates to a gas turbine engine, and more particularly to a blade outer air seal (BOAS) that may be incorporated into a gas turbine engine.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

A casing of an engine static structure may include one or more blade outer air seals (BOAS) that provide an outer radial flow path boundary of the core flow path. One or more BOAS may be positioned in relative close proximity to a blade tip of each rotating blade in order to seal between the blades and the casing. BOAS may require a mechanical stop to circumferentially retain the BOAS to the casing.

SUMMARY

A blade outer air seal (BOAS) for a gas turbine engine according to an exemplary aspect of the present disclosure includes, among other things, a seal body having a radially inner face and a radially outer face that axially extend between a leading edge portion and a trailing edge portion. At least one of the leading edge portion and the trailing edge portion includes a solid wall and a perforated wall. At least a portion of the perforated wall is spaced from the solid wall such that a passage extends between the solid wall and the perforated wall.

In a further non-limiting embodiment of the foregoing BOAS, the solid wall includes a vertical wall and a hooked flange that extends from the vertical wall.

In a further non-limiting embodiment of either of the foregoing BOAS, a vertical wall of the perforated wall extends between a radially outer flange and a radially inner flange of the perforated wall.

In a further non-limiting embodiment of any of the foregoing BOAS, the solid wall and the perforated wall are disposed at the leading edge portion of the seal body.

In a further non-limiting embodiment of any of the foregoing BOAS, the solid wall and the perforated wall are disposed at the trailing edge portion of the seal body.

In a further non-limiting embodiment of any of the foregoing BOAS, the solid wall contacts the perforated wall at a first location radially outward from the passage and a second location radially inward from the passage.

In a further non-limiting embodiment of any of the foregoing BOAS, a seal is attached to the radially inner face of the seal body.

In a further non-limiting embodiment of any of the foregoing BOAS, the seal is a honeycomb seal.

In a further non-limiting embodiment of any of the foregoing BOAS, the perforated wall includes a hole that receives a vane segment to circumferentially retain the BOAS.

In a further non-limiting embodiment of any of the foregoing BOAS, the passage is box shaped.

In a further non-limiting embodiment of any of the foregoing BOAS, the passage is radially and axially bound by the solid wall and the perforated wall.

A gas turbine engine according to an exemplary aspect of the present disclosure includes, among other things, a compressor section, a combustor section in fluid communication with the compressor section and a turbine section in fluid communication with the combustor section. A blade outer air seal (BOAS) is associated with at least one of the compressor section and the turbine section. The BOAS includes a seal body having a radially inner face and a radially outer face that axially extend between a leading edge portion and a trailing edge portion. At least one of the leading edge portion and the trailing edge portion includes a solid wall and a perforated wall. At least a portion of the perforated wall is spaced from the solid wall such that a passage extends between the solid wall and the perforated wall.

In a further non-limiting embodiment of the foregoing gas turbine engine, the passage is radially and axially bound by the solid wall and the perforated wall.

In a further non-limiting embodiment of either of the foregoing gas turbine engines, the passage radially extends between a hooked flange of the solid wall and a radially outer flange of the perforated wall.

In a further non-limiting embodiment of any of the foregoing gas turbine engines, the passage axially extends between a vertical wall of each of the solid wall and the perforated wall.

In a further non-limiting embodiment of any of the foregoing gas turbine engines, the solid wall and the perforated wall are disposed at the leading edge portion of the seal body.

A method of retaining a blade outer air seal (BOAS) to a gas turbine engine according to another exemplary aspect of the present disclosure includes, among other things, receiving a segment of a component through a perforated wall of the BOAS to circumferentially retain the BOAS to the gas turbine engine. A portion of the perforated wall is spaced from a solid wall of the BOAS such that the segment is partially received within a passage that extends between the perforated wall and the solid wall.

In a further non-limiting embodiment of the foregoing method, the segment is received through a hole in the perforated wall.

In a further non-limiting embodiment of either of the foregoing methods, the segment is a vane segment of a vane.

In a further non-limiting embodiment of any of the foregoing methods, the BOAS is radially retained to the gas turbine engine at both the solid wall and the perforated wall.

The various features and advantages of this disclosure will become apparent to those skilled in the art from the following detailed description. The drawings that accompany the detailed description can be briefly described as follows.

DETAILED DESCRIPTION

Figure 1:
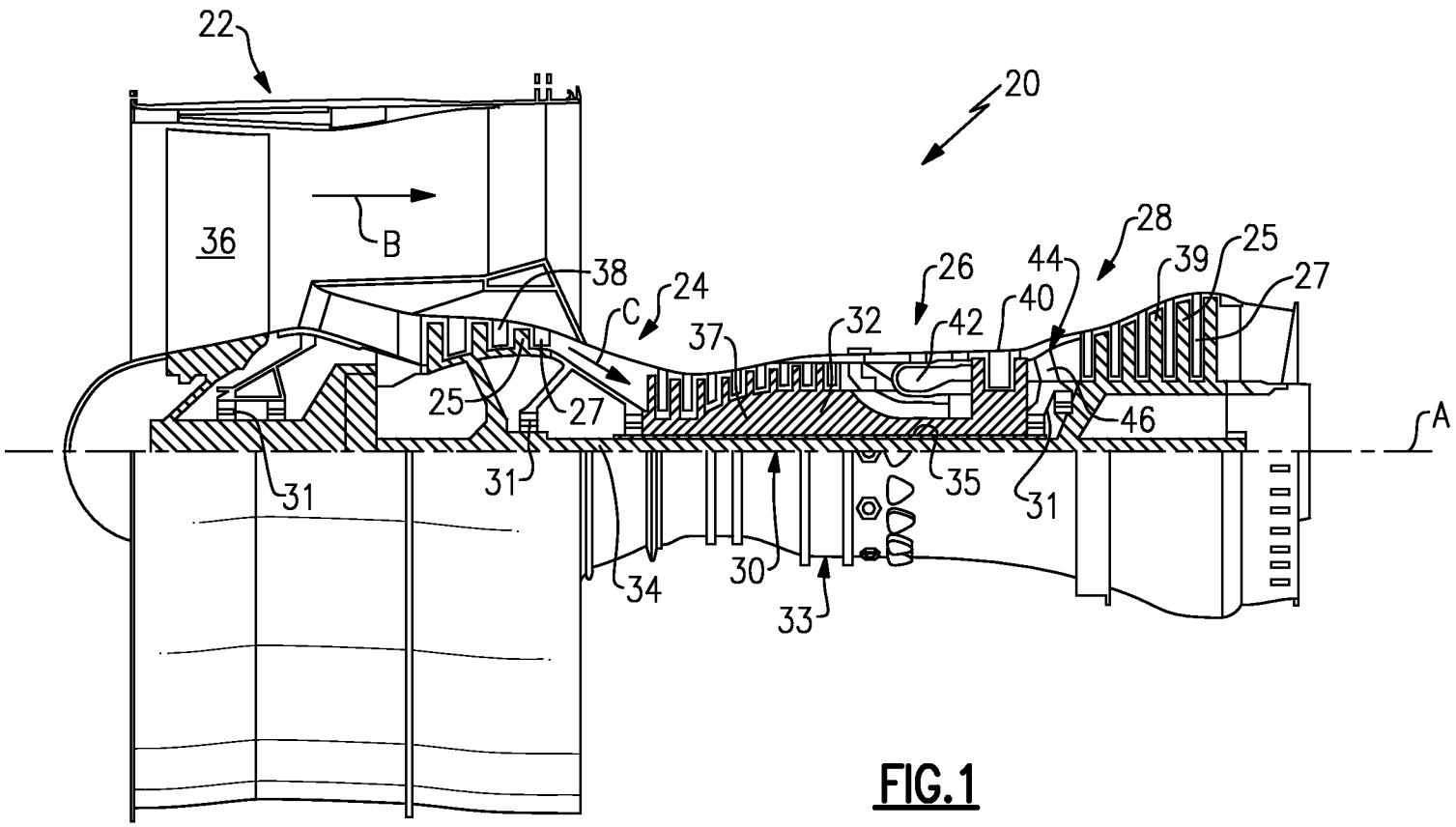
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, turboshaft engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 supports one or more bearing systems 31 of the turbine section 28. The mid-turbine frame 44 may include one or more airfoils 46 that may be positioned within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from core airflow that is communicated through the gas turbine engine 20. The vanes 27 of the vane assemblies direct core airflow to the blades 25 of the rotor assemblies to either add or extract energy. As is discussed in greater detail below, blade outer air seals (BOAS) can be positioned in relative close proximity to the blade tip of each blade in order to seal between the blades and the engine static structure 33.

Figure 2:
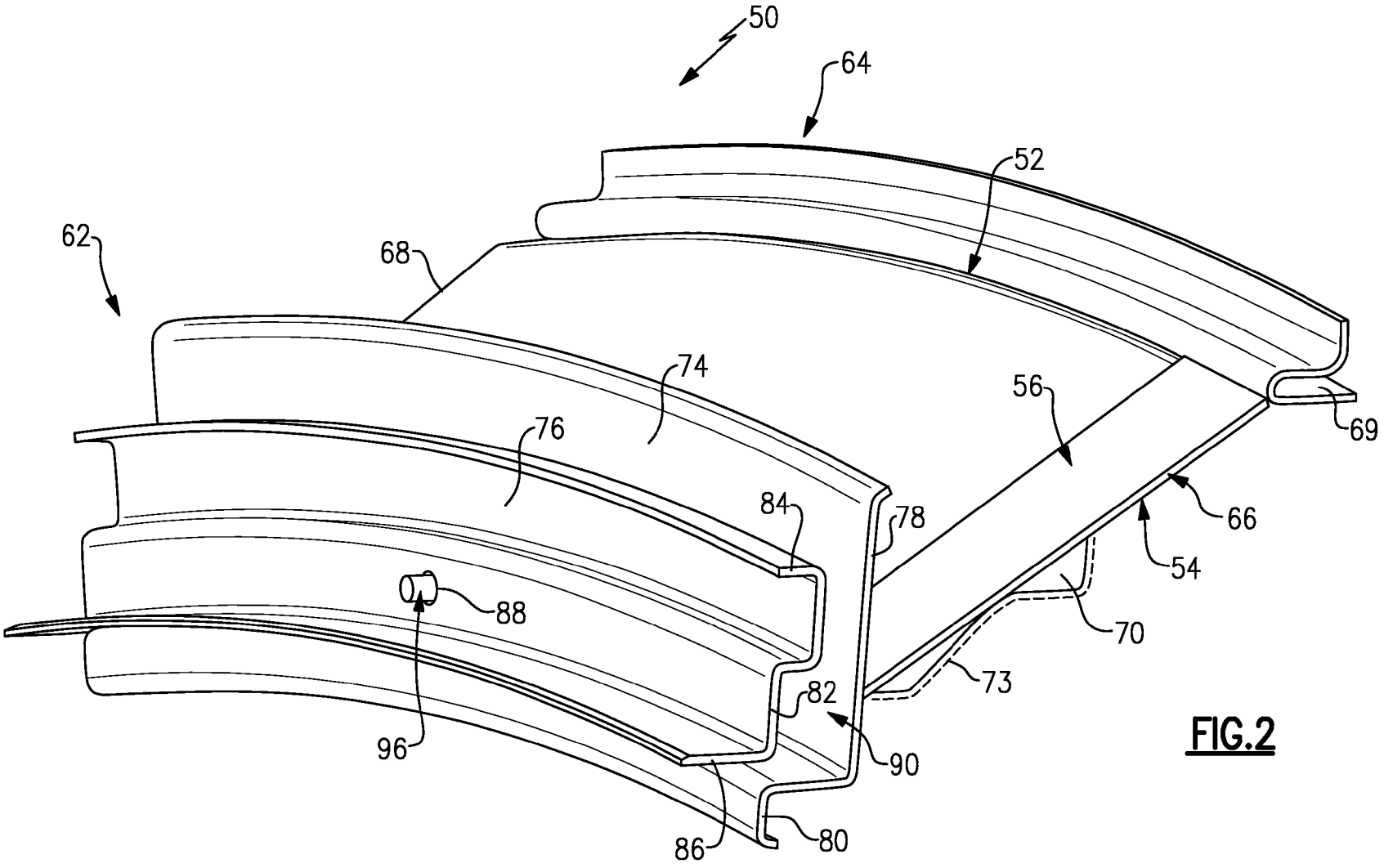
FIG. 2 illustrates a blade outer air seal (BOAS) that can be incorporated into a gas turbine engine.
Figure 3:
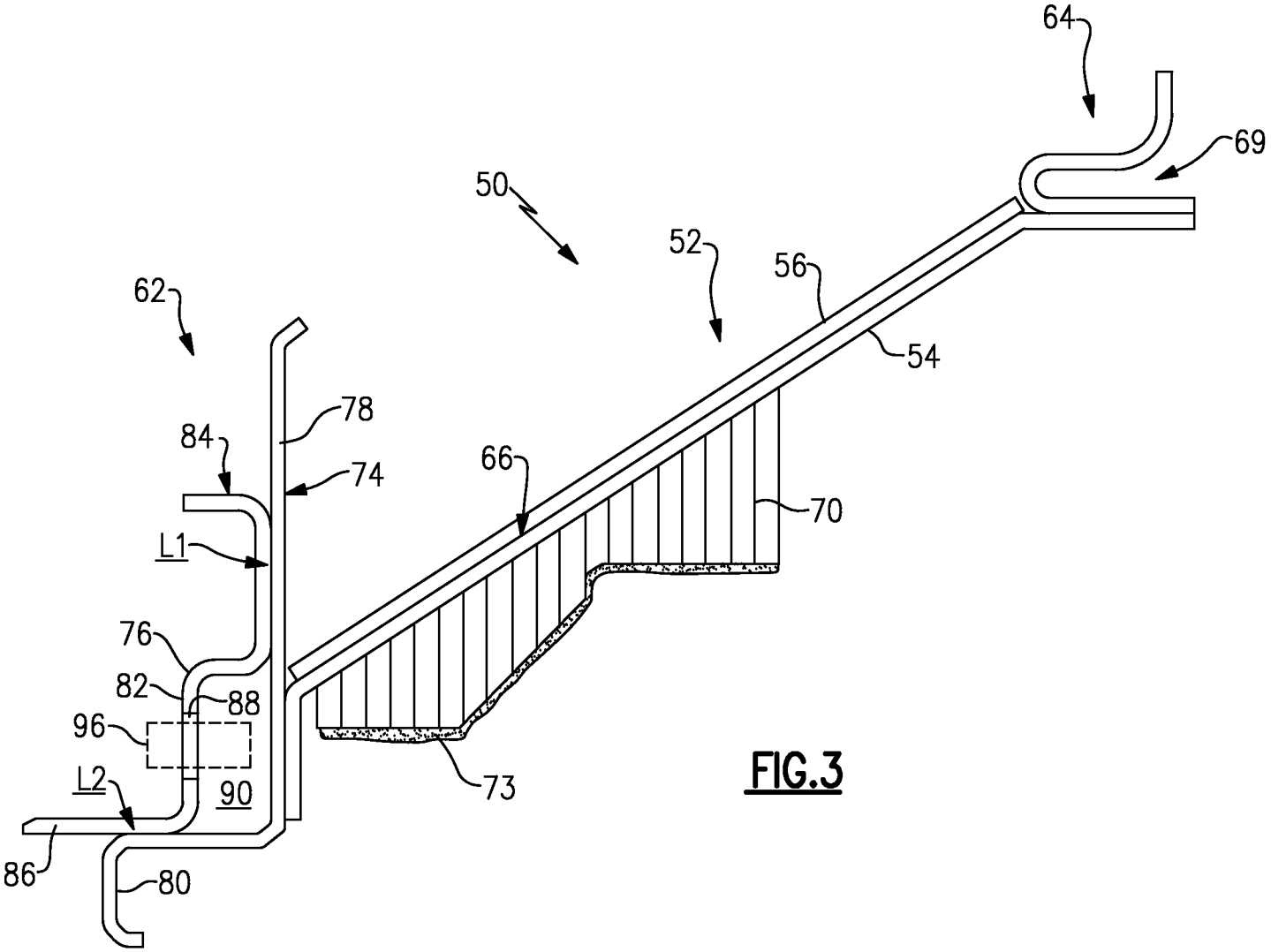
FIG. 3 illustrates a cross-sectional view of the BOAS of FIG. 2.

FIGS. 2 and 3 illustrate one exemplary embodiment of a BOAS 50 that may be incorporated into a gas turbine engine, such as the gas turbine engine 20. The BOAS 50 of this exemplary embodiment is a segmented BOAS that can be positioned and assembled relative to a multitude of additional BOAS segments to form a full ring hoop assembly that circumscribes the rotating blades 25 of either the compressor section 24 or the turbine section 28 of the gas turbine engine 20. The BOAS 50 can be circumferentially disposed about the engine centerline longitudinal axis A (See FIG. 5). It should be understood that the BOAS 50 could embody other designs and configurations within the scope of this disclosure.

The BOAS 50 includes a seal body 52 having a radially inner face 54 and a radially outer face 56. The seal body 52 axially extends between a leading edge portion 62 and a trailing edge portion 64, and circumferentially extends between a first mate face 66 and a second mate face 68. The BOAS 50 may be constructed from any suitable sheet metal. Other materials, including but not limited to high temperature metallic alloys, are also contemplated as within the scope of this disclosure.

A seal 70 can be secured to the radially inner face 54 of the seal body 52. The seal 70 may be brazed or welded to the radially inner face 54, or could be attached using other techniques. In one exemplary embodiment, the seal 70 is a honeycomb seal that interacts with a blade tip 58 of a blade 25 (see FIG. 5) to reduce airflow leakage around the blade tip 58. A thermal barrier coating 73 can also be applied to at least a portion of the radially inner face 54 and/or the seal 70 to protect the underlying substrate of the BOAS 50 from thermal fatigue and to enable higher operating conditions. Any suitable thermal bather coating 73 could be applied to any portion of the BOAS 50.

Figure 4:
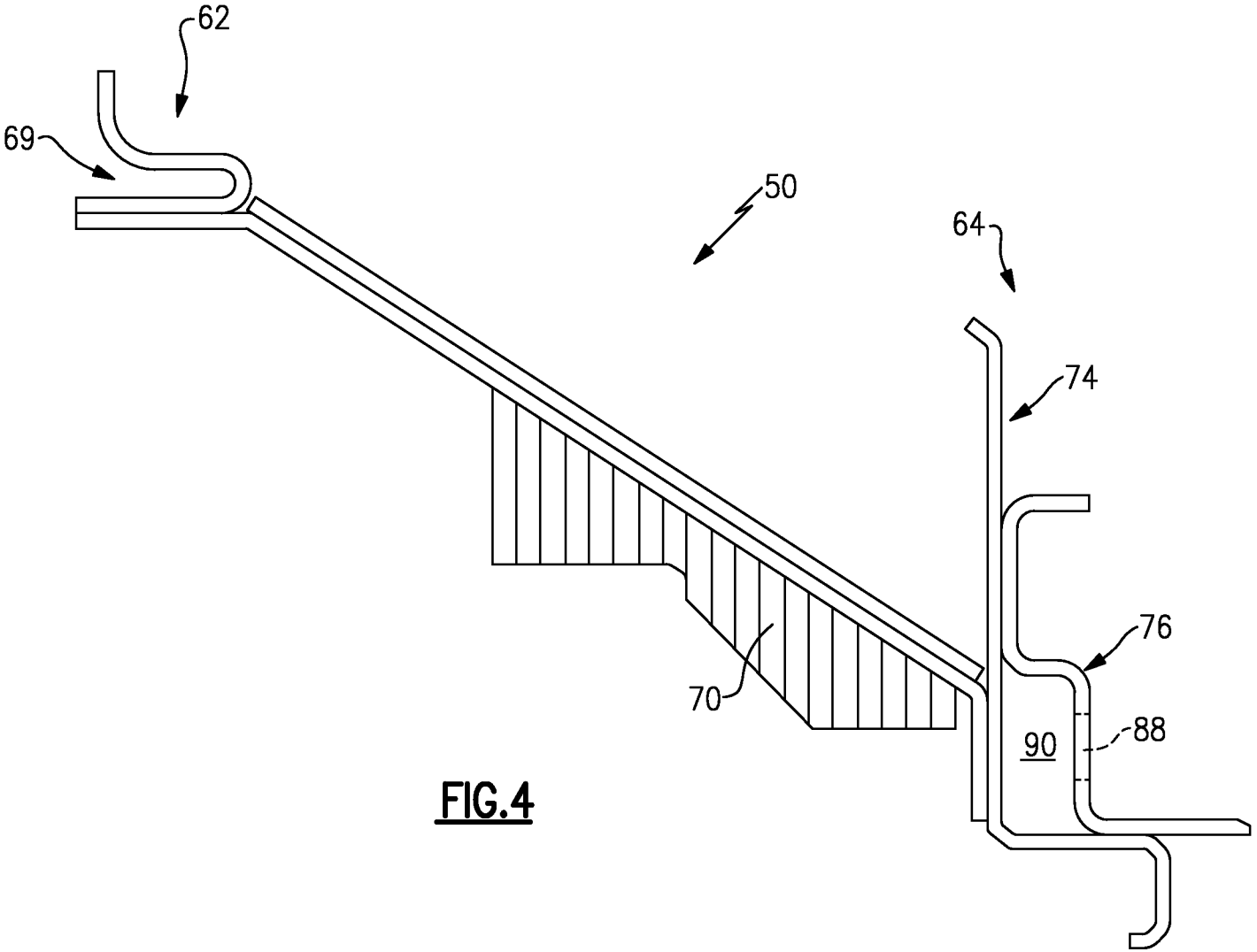
FIG. 4 illustrates another exemplary BOAS that can be incorporated into a gas turbine engine.

In one exemplary embodiment, one of the leading edge portion 62 and the trailing edge portion 64 of the BOAS 50 includes a solid wall 74 and a perforated wall 76. In this exemplary embodiment, the solid wall 74 and the perforated wall 76 are disposed on the leading edge portion 62 of the BOAS 50. However, as shown in FIG. 4, these features could also be disposed at the trailing edge portion 64. The opposite portion of the seal body 52 from the solid wall 74 and the perforated wall 76 (in this embodiment, the trailing edge portion 64) can also include an engagement feature 69 for securing the BOAS 50. The engagement feature 69 could include a hook, a flange or any other suitable structure for supporting the BOAS 50 relative to the engine static structure 33 (See FIG. 5).

In one embodiment, each of the solid wall 74 and the perforated wall 76 are attached to the seal body 52, such as by brazing or welding. Alternatively, the solid wall 74 and the perforated wall 76 could be formed integrally with the seal body 52 as a monolithic piece. In one exemplary embodiment, the solid wall 74 is connected to the seal body 52 and the perforated wall 76 is connected to the solid wall 74.

In this exemplary embodiment, the solid wall 74 includes a vertical wall 78 and a hooked flange 80 that extends from the vertical wall 78. The hooked flange 80 may extend perpendicularly from the vertical wall 78. The perforated wall 76 can include a vertical wall 82 that extends between a radially outer flange 84 and a radially inner flange 86. The vertical wall 82 of the perforated wall 76 can include a hole 88 that can receive a protruding segment 96 of a neighboring component within the gas turbine engine 20 to circumferentially retain the BOAS 50, as is further discussed below.

The vertical wall 82 of the perforated wall 76 can be spaced from the vertical wall 78 of the solid wall 74 such that a passage 90 extends between the vertical walls 82, 78. The perforated wall 76 can contact the solid wall 74 at a first location L1 that is radially outward from the passage 90 and at a second location L2 that is radially inward from the passage 90. The passage 90 can be box-shaped and is axially and radially bound by the solid wall 74 and the perforated wall 76. In this particular embodiment, the passage 90 axially extends between the vertical walls 78, 82 and radially extends between the hooked flange 80 of the solid wall 74 and the radially outer flange 84 of the perforated wall 76. The passage 90 opens to the first and second mate faces 66, 68 of the seal body 52 to provide a nearly enclosed passage for the communication of airflow leakage. The airflow leakage is not communicated to any other cavity except past the first and second mate faces 66, 68 (i.e., in the circumferential direction), which already establish a leakage path.

Figure 5:
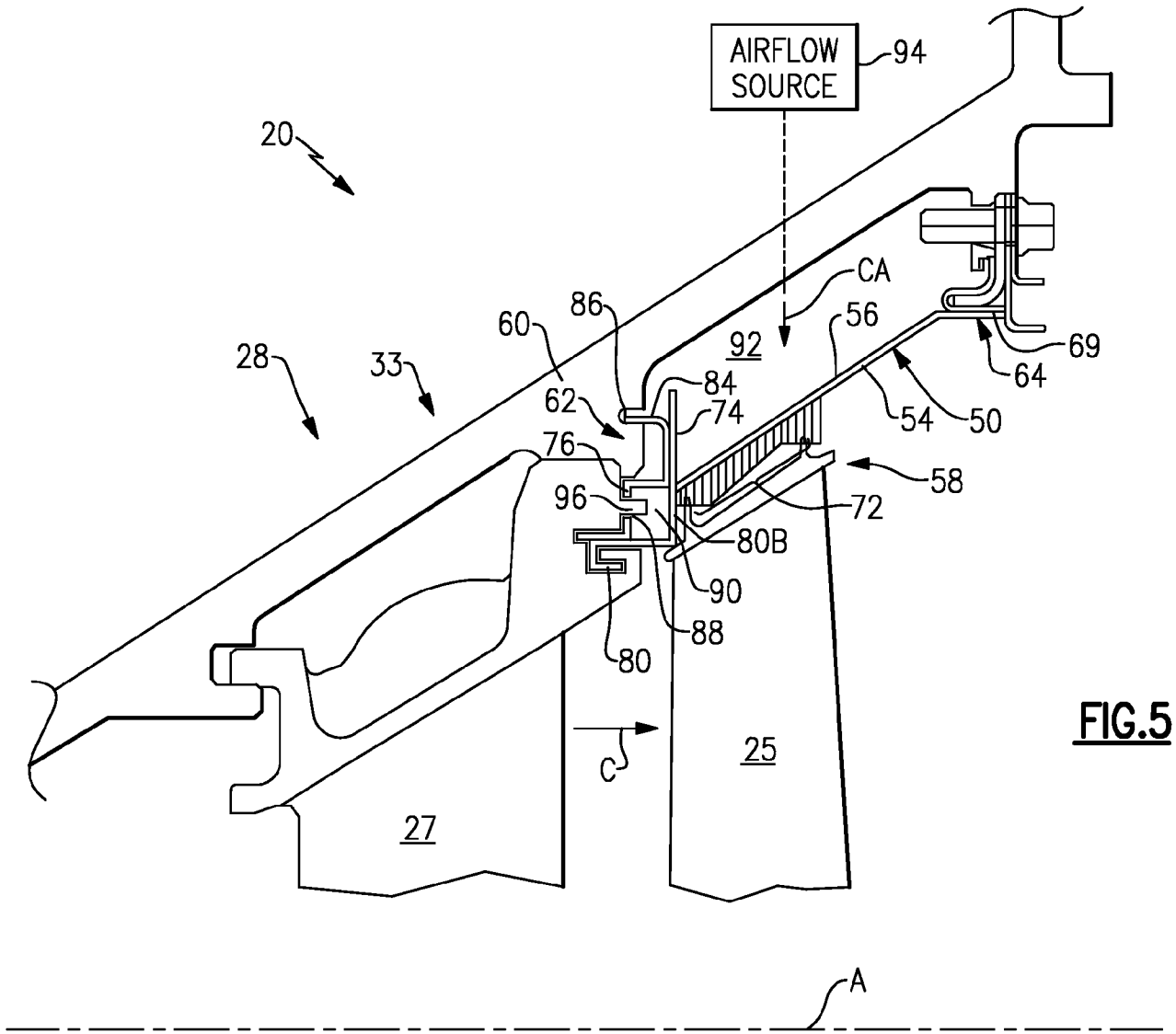
FIG. 5 illustrates a cross-sectional view of a portion of a gas turbine engine that can incorporate a BOAS.

FIG. 5 illustrates a cross-sectional view of the BOAS 50 mounted within the gas turbine engine 20. The BOAS 50 is mounted radially inward from a casing 60 of the engine static structure 33. The casing 60 may be an outer engine casing of the gas turbine engine 20. In this exemplary embodiment, the BOAS 50 is mounted within the turbine section 28 of the gas turbine engine 20. However, it should be understood that other portions of the gas turbine engine 20 could benefit from the teachings of this disclosure, including but not limited to, the compressor section 24.

In this exemplary embodiment, a blade 25 (only one shown, although multiple blades could be circumferentially disposed about a rotor disk (not shown) within the gas turbine engine 20) is mounted for rotation relative to the casing 60 of the engine static structure 33. In the turbine section 28, the blade 25 rotates to extract energy from the hot combustion gases that are communicated through the gas turbine engine 20 along the core flow path C. A vane 27 is also supported within the casing 60 adjacent to the blade 25. The vane 27 (additional vanes could be circumferentially disposed about the engine longitudinal centerline axis A as part of a vane assembly) prepares the core airflow for the blade(s) 25. Additional rows of vanes could also be disposed downstream from the blade 25.

The blade 25 includes a blade tip 58 at a radially outermost portion of the blade 25. In this exemplary embodiment, the blade tip 58 includes a knife edge 72 that extends toward the BOAS 50. The BOAS 50 establishes an outer radial flow path boundary of the core flow path C. The knife edge 72 and the BOAS 50 cooperate to limit airflow leakage around the blade tip 58. The radially inner face 54 of the BOAS faces toward the blade tip 58 of the blade 25 (i.e., the radially inner face 54 is positioned on the core flow path C side) and the radially outer face 56 faces the casing 60 (i.e., the radially outer face 56 is positioned on a non-core flow path side).

The BOAS 50 is disposed in an annulus radially between the casing 60 and the blade tip 58. Although this particular embodiment is illustrated in cross-section, the BOAS 50 may be attached at its mate faces 66, 68 (See FIG. 2) to additional blade outer air seals to circumscribe associated blades 25 of the compressor section 24 or the turbine section 28. A cavity 92 radially extends between the casing 60 and the radially outer face 56 of the BOAS 50. The cavity 92 can receive a dedicated cooling airflow CA from an airflow source 94, such as bleed airflow from the compressor section 24, that can be used to cool the BOAS 50.

The BOAS 50 may be radially and circumferentially retained relative to the casing 60 via the solid wall 74 and the perforated wall 76. In this exemplary embodiment, the leading edge portion 62 is radially retained to the casing 60 by the radially outer flange 84 of the perforated wall 76 and the hooked flange 80 of the solid wall 74. The trailing edge portion 64 can be radially retained to the casing via the engagement feature 69. A segment 96, such as a vane segment of a vane 27, can be received through the hole 88 of the perforated wall 76 and into the passage 90 to circumferentially retain the BOAS 50 relative to the casing 60 (i.e., prevent circumferential rotation of the BOAS 50 about the engine longitudinal centerline axis A). It should be understood that other segments of other components may additionally or alternatively be received within the passage 90 to circumferentially retain the BOAS 50.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

What is claimed is:

1. A blade outer air seal (BOAS) for a gas turbine engine, comprising:

a seal body having a radially inner face and a radially outer face that axially extend between a leading edge portion and a trailing edge portion; and wherein at least one of said leading edge portion and said trailing edge portion includes a solid wall and a perforated wall, wherein at least a portion of said perforated wall is spaced from said solid wall such that a passage extends between said solid wall and said perforated wall, and said perforated wall includes a hole that receives a vane segment to circumferentially retain the BOAS.

2. The BOAS as recited in claim 1, wherein said solid wall includes a vertical wall and a hooked flange that extends from said vertical wall.

3. The BOAS as recited in claim 1, wherein a vertical wall of said perforated wall extends between a radially outer flange and a radially inner flange of said perforated wall.

4. The BOAS as recited in claim 1, wherein said solid wall and said perforated wall are disposed at said leading edge portion of said seal body.

5. The BOAS as recited in claim 1, wherein said solid wall and said perforated wall are disposed at said trailing edge portion of said seal body.

6. The BOAS as recited in claim 1, wherein said solid wall contacts said perforated wall at a first location radially outward from said passage and a second location radially inward from said passage.

7. The BOAS as recited in claim 1, comprising a seal attached to said radially inner face of said seal body.

8. The BOAS as recited in claim 7, wherein said seal is a honeycomb seal.

9. The BOAS as recited in claim 1, wherein said passage is box shaped.

10. The BOAS as recited in claim 1, wherein said passage is radially and axially bound by said solid wall and said perforated wall.

11. A gas turbine engine, comprising:

a compressor section;

a combustor section in fluid communication with said compressor section;

a turbine section in fluid communication with said combustor section;

a blade outer air seal (BOAS) associated with at least one of said compressor section and said turbine section, wherein said BOAS includes:

a seal body having a radially inner face and a radially outer face that axially extend between a leading edge portion and a trailing edge portion; and at least one of said leading edge portion and said trailing edge portion including a solid wall and a perforated wall, wherein at least a portion of said perforated wall is spaced from said solid wall such that a passage extends between said solid wall and said perforated wall, and said perforated wall includes a hole that receives a vane segment to circumferentially retain the BOAS.

12. The gas turbine engine as recited in claim 11, wherein said passage is radially and axially bound by said solid wall and said perforated wall.

13. The gas turbine engine as recited in claim 11, wherein said passage radially extends between a hooked flange of said solid wall and a radially outer flange of said perforated wall.

14. The gas turbine engine as recited in claim 11, wherein said passage axially extends between a vertical wall of each of said solid wall and said perforated wall.

15. The gas turbine engine as recited in claim 11, wherein said solid wall and said perforated wall are disposed at said leading edge portion of said seal body.

16. A method of retaining a blade outer air seal (BOAS) to a gas turbine engine, comprising:

receiving a vane segment through a perforated wall of the BOAS to circumferentially retain the BOAS to the gas turbine engine, wherein a portion of the perforated wall is spaced from a solid wall of the BOAS such that the segment is partially received within a passage that extends between the perforated wall and the solid wall.

17. The method as recited in claim 16, wherein the segment is received through a hole in the perforated wall.

18. The method as recited in claim 16, comprising the step of:

radially retaining the BOAS to the gas turbine engine at both the solid wall and the perforated wall.

* * * * *

UNITED STATES PATENT AND TRADEMARK OFFICE

CERTIFICATE OF CORRECTION

PATENT NO. : 9,115,596 B2
APPLICATION NO. : 13/568240
DATED : August 25, 2015
INVENTOR(S) : Brian Ellis Clouse It is certified that error appears in the above-identified patent and that said Letters Patent is hereby corrected as shown below:

In the specification,

Col. 4, Line 37
Delete "bather"
Insert --barrier--

Signed and Sealed this
Ninth Day of February, 2016

Michelle K. Lee

Michelle K. Lee
*Director of the United States Patent and Trademark Office*